US007325412B2

(12) United States Patent
Yun et al.

(10) Patent No.: US 7,325,412 B2
(45) Date of Patent: Feb. 5, 2008

(54) VIBRATION-ABSORBING SUPPORTING APPARATUS OF WINE REFRIGERATOR

(75) Inventors: Young-Hoon Yun, Daegu (KR); Yong-Gu Kim, Seoul (KR); Tae-Hee Lee, Seoul (KR); Dong-Hoon Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 72 days.

(21) Appl. No.: 11/031,066

(22) Filed: Jan. 10, 2005

(65) Prior Publication Data

US 2005/0257555 A1 Nov. 24, 2005

(30) Foreign Application Priority Data

May 18, 2004 (KR) ..... 10-2004-0035357

(51) Int. Cl.
*F25D 19/00* (2006.01)

(52) U.S. Cl. ..... 62/295; 248/188.4

(58) Field of Classification Search ..... 62/295; 248/188.2, 188.4

See application file for complete search history.

(56) References Cited

U.S. PATENT DOCUMENTS

| | | | | |
|---|---|---|---|---|
| 1,145,096 | A | 7/1915 | Thomes | |
| 2,464,613 | A | 3/1949 | Rosenzweig | |
| 3,575,288 | A * | 4/1971 | Brucken | 206/320 |
| 4,789,121 | A * | 12/1988 | Gidseg et al. | 248/188.2 |
| 4,798,359 | A | 1/1989 | Ball | |
| 4,955,569 | A * | 9/1990 | Hottmann | 248/188.2 |
| 5,794,912 | A * | 8/1998 | Whittaker et al. | 248/638 |
| 5,836,556 | A * | 11/1998 | Kim | 248/188.4 |
| 5,890,696 | A | 4/1999 | Ozawa | |
| 5,967,472 | A * | 10/1999 | Wilhelmstatter et al. | 248/188.4 |
| 6,260,373 | B1 * | 7/2001 | Rockwood | 62/295 |
| 2002/0139909 | A1 | 10/2002 | Oyama et al. | |
| 2003/0025051 | A1 * | 2/2003 | MacDonald | 248/188.4 |

FOREIGN PATENT DOCUMENTS

| | | | |
|---|---|---|---|
| FR | 54 297 | E | 9/1948 |
| GB | 1 160 274 | A | 8/1969 |
| JP | 02-154831 | A | 6/1990 |
| JP | 9-229544 | A | 9/1997 |
| KR | 1993-0003107 | | 5/1993 |
| KR | 10-2001-0003377 | A | 1/2001 |

* cited by examiner

*Primary Examiner*—William E. Tapolcai
(74) *Attorney, Agent, or Firm*—Birch, Stewart, Kolasch & Birch, LLP

(57) ABSTRACT

A vibration-absorbing supporting apparatus of a wine refrigerator comprises: a base member fixedly coupled to a lower portion of a wine refrigerator main body; a height control member coupled to the base member so as to control a height of the main body vertically; a floor supporting means coupled to the height control member to make a relative motion to the height control member in a vertical direction, and contacting with and supported on a floor on which the wine refrigerator is installed; and an elastic supporting member coupled between the height control member and the floor supporting means, for elastically supporting the base member coupled to the main body. Accordingly, wine bottles stored in the wine refrigerator are prevented from being shaken by external vibration, so that unique flavor of wine is maintained.

20 Claims, 5 Drawing Sheets

VIBRATION-ABSORBING SUPPORTING APPARATUS OF WINE REFRIGERATOR

BACKGROUND OF THE INVENTION

1. Field of the Invention

The present invention relates to a wine refrigerator, and particularly, to a vibration-absorbing supporting apparatus of a wine refrigerator capable of preventing shaking of wine bottles stored in a wine refrigerator due to external vibration.

2. Description of the Background Art

A refrigerator is provided with a refrigerating cycle system therein. An evaporator constituting the refrigerating cycle system generates the cool air, and the cool air circulates inside the refrigerator, so that the interior of the refrigerator is maintained in a cooled state.

Such a refrigerator can be classified into a variety of types according to its structural characteristics, and is being developed into a variety of kinds according to kinds of items stored therein.

Recently, a cosmetic refrigerator and a wine refrigerator have been developed for storing cosmetics and wine bottles in an optimum state without quality deterioration.

Like a general refrigerator, the wine refrigerator includes: a main body provided with a storing compartment in which wine bottles are stored; and a door mounted at one side of the main body, for opening or closing the storing compartment.

A refrigerating cycle system is provided at the main body, and, in the refrigerating cycle system, a compressor and a condenser for generating vibration noise and heat are mounted in a machine room provided at a lower portion of the main body.

FIG. 1 is an exploded perspective view showing a lower portion of a conventional wine refrigerator, and FIG. 2 is a sectional view showing a lower portion of the wine refrigerator.

As shown, the wine refrigerator has a mounting space (R) of a predetermined size at a rear side of a lower portion of the main body 100 having therein a storing compartment. A bottom plate 110 having a predetermined area is coupled to a lower surface of the main body 100 by a plurality of screws, and a cover 200 for covering a rear side of the mounting space (R) is coupled to a rear surface of the lower portion of the main body 100 by a plurality of screws 210.

The bottom plate 110 covers the lower surface of the mounting space (R) of the main body 100. The bottom plate 110 and the mounting space (R) form a machine room.

A compressor 300 is installed at the bottom plate 110 and placed in the machine room, a control box 400 is mounted to a side wall of the machine room, and a defrosted-water tray 500 is installed at an upper surface of the machine room above the compressor 300. Water generated as frost melts in the evaporator (not shown) gathers and evaporates in the defrosted-water tray 500.

The compressor 300 includes: a hermetic container 310 and a plurality of mounting plates 320 coupled to a bottom of the hermetic container 310. A suction pipe 330 and a discharged pipe 340 for sucking and discharging of a refrigerant are connected to the hermetic container 310, respectively. Also, the suction pipe 330 is connected with the evaporator, and the discharge pipe 340 is connected to a condenser (not shown) constituting the refrigerating cycle system.

A vibration-proof rubber 350 for suppressing vibration transmission is provided between the mounting plate 320 of the compressor and the bottom plate 110.

Front legs 120 for supporting the main body 100 are coupled to corners of both sides of the front of the bottom plate 110 mounted at the lower surface of the main body 100, respectively. Two rear legs 130 for supporting the main body 100 are coupled to the rear of the bottom plate 110 at a certain interval therebetween.

The front leg 120 includes: a rotation supporting portion 121 formed as a cylindrical shape with a certain length and having protrusions formed on its outer circumferential surface at regular intervals; a shaft portion 122 extending from the rotation supporting portion 121 at a certain length; and a male screw portion formed at an end portion of the shaft portion 122.

A female screw portion (not shown) is formed at a front corner of the bottom plate 110 placed at the lower surface of the main body 100. By threading of the male screw portion into the female screw portion of the main body 100, the front leg 120 is coupled to the lower surface of the main body 100.

The rear leg 130 is formed as a rotatable roller.

A roller mounting portion 111 is penetratingly formed at the rear of the bottom plate 110 coupled to the lower surface of the main body 100. The roller, the rear leg 130, is inserted in the roller mounting portion 111, and a coupling pin 131 having a predetermined length is penetratingly inserted in the roller, so that the roller is coupled to the bottom plate 110.

The front leg 120 not only supports the wine refrigerating but also rotates the rotating supporting portion 121, thereby controlling a height. Thus, a horizontal and vertical state of the main body 100 to a floor is properly maintained. Also, because the rear leg 130 comprises a roller, it can support the wine refrigerator together with the front leg 120, and allows a smooth movement of the wine refrigerator during relocation.

Undescribed reference mark 360 is a dryer, 220 is an air hole, and 'D' is a door.

In general, wine undergoes ripening even in a wine bottle. Therefore, in order to keep unique flavor of wine, handling and storing of bottled wine requires special care and efforts. In handing and storing of bottled wine, especially, issues on a temperature, sunshine, humidity, and shaking and a horizon state of a bottle should be handled attentively.

In a developing process for a wine refrigerator, issues on sunshine, humidity and horizontal state can be relatively easily solved. However, it is difficult to handle issues on the proper temperature maintaining and the vibration preventing of the wine bottle, and lots of related researches are actively ongoing.

Despite such efforts, the conventional wine refrigerator has the following problems. If the wine refrigerator is installed in a room or other places and vibration is generated from a refrigerator or other appliances installed near the wine refrigerator, the vibration is transmitted to the wine refrigerator through a floor and thus vibrates the wine refrigerator. Consequently, wine bottles stored in the wine refrigerator are undesirably shaken. Namely, the main body 100 of the wine refrigerator is supported on a floor by the front legs 120 and the rear legs 130. Thus, if vibration is generated at the floor which is in contact with the front legs 120 and the rear legs 130, the vibration is transmitted to the main body 100 through the front legs 120 and the rear legs 130, thereby causing undesirable vibration of the main body 100. As the main body 100 is vibrated, wine bottles stored in the main body 100 are shaken, degrading unique flavor of wine.

SUMMARY OF THE INVENTION

Therefore, an object of the present invention is to provide a vibration-absorbing supporting apparatus of a wine refrigerator capable of preventing shaking of wine bottles stored in the wine refrigerator due to external vibration.

To achieve these and other advantages and in accordance with the purpose of the present invention, as embodied and broadly described herein, there is provided a vibration-absorbing supporting apparatus of a wine refrigerator comprising: a base member fixedly coupled to a lower portion of a wine refrigerator main body; a height control member coupled to the base member so as to control a height of the main body vertically; a floor supporting means coupled to the height control member to make a relative motion to the height control member in a vertical direction, and contacting with and supported on a floor on which the wine refrigerator is installed; and an elastic supporting member coupled between the height control member and the floor supporting means, for elastically supporting the base member coupled to the main body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
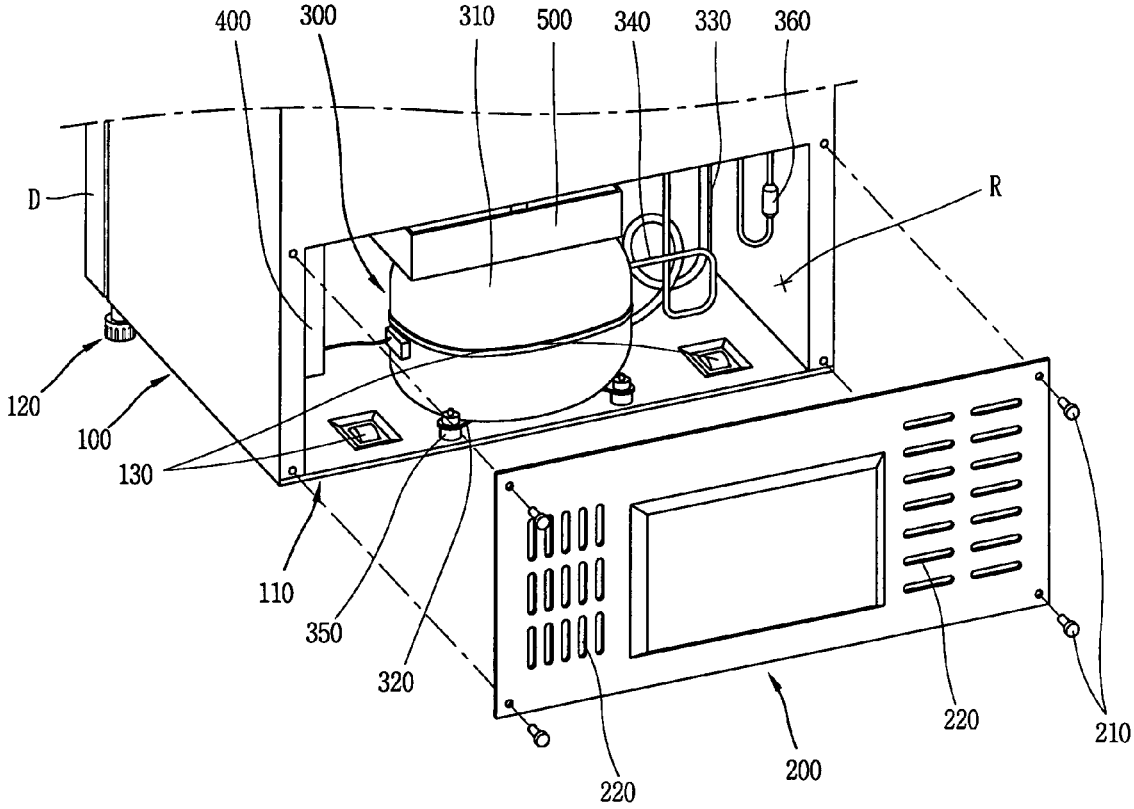
FIG. 1 CONVENTIONAL ART
FIG. 1 is an exploded perspective view showing a lower portion of a conventional wine refrigerator.
Figure 2:
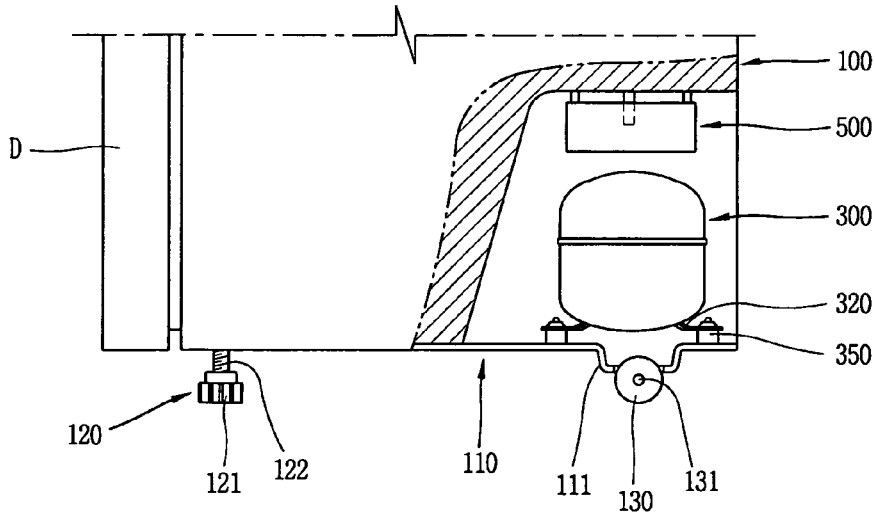
FIG. 2 CONVENTIONAL ART
FIG. 2 is a side view showing a partially sectioned lower portion of the wine refrigerator.
Figure 3:
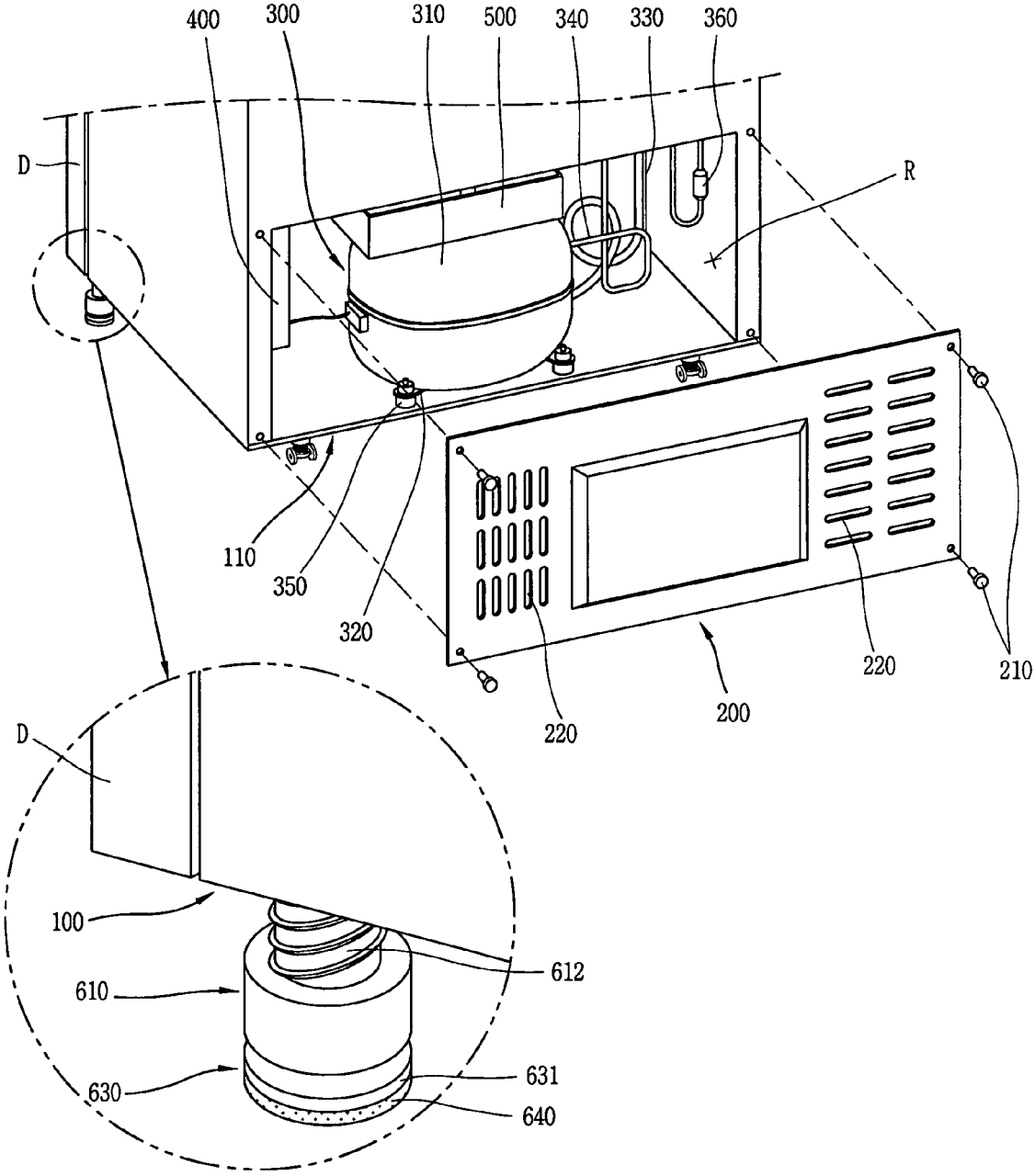
FIG. 3 is an exploded perspective view showing a lower portion of a wine refrigerator provided with a vibration-absorbing supporting apparatus in accordance with one embodiment of the present invention.
Figure 4:
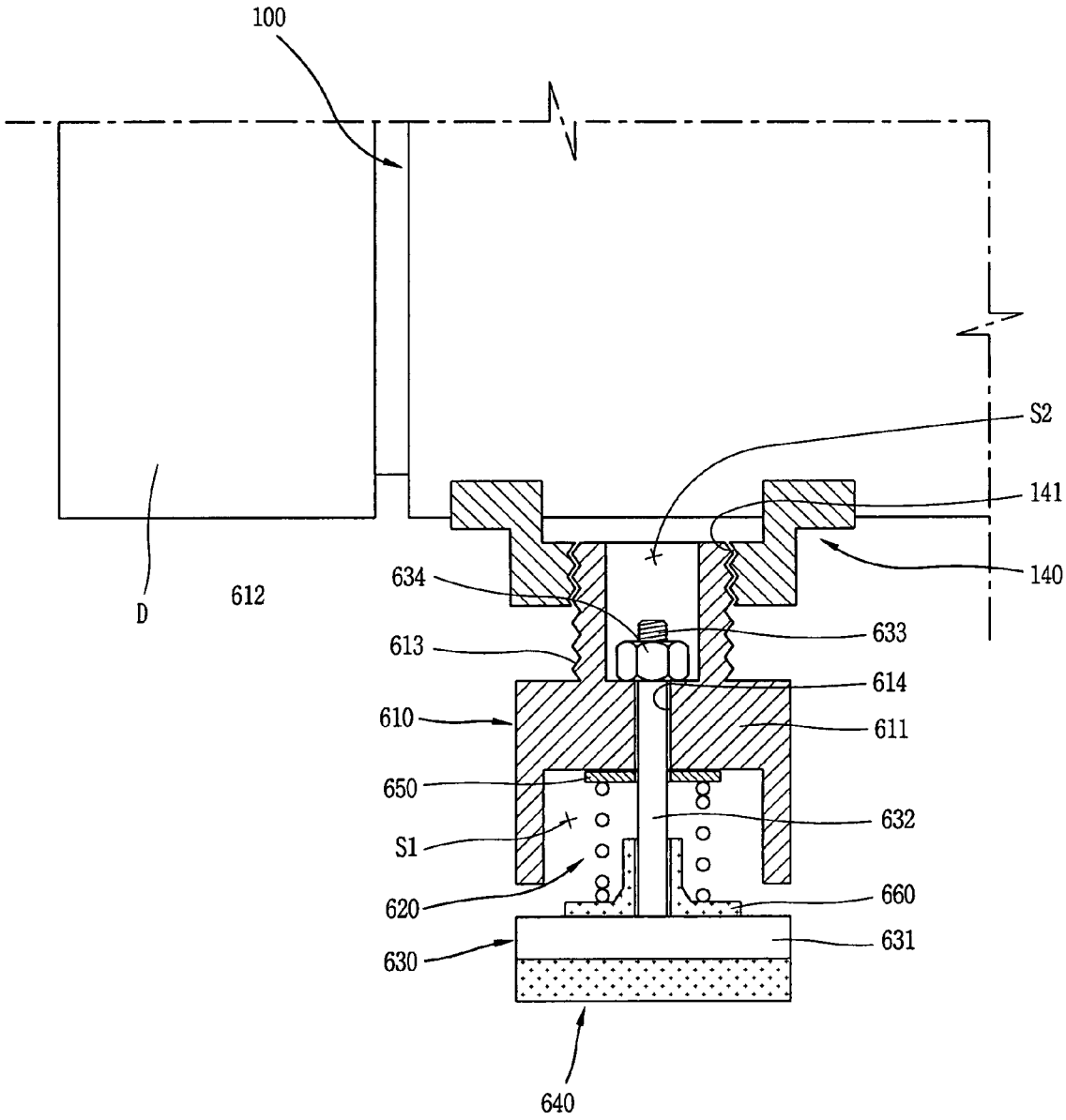
FIG. 4 is a sectional view showing one embodiment of the vibration-absorbing supporting apparatus of the wine refrigerator in accordance with the present invention.

FIG. 3 is a perspective view showing a lower portion of a wine refrigerator provided with a vibration-absorbing supporting apparatus in accordance with one embodiment of the present invention, and FIG. 4 is a sectional view showing the vibration-absorbing supporting apparatus of the wine refrigerator. Like references numerals designate like or corresponding parts.

As shown, the vibration-absorbing supporting apparatus of the wine refrigerator includes: a base member 140 fixedly coupled to a lower portion of a main body 100 having a storing compartment (not shown) therein; a height control member 610 coupled to the base member 140, for controlling a height of the main body 100 in a vertical direction; a floor supporting means coupled to the height control member to make a relative motion to the height control member 610 in a vertical direction and contacting with and supported on a floor on which the refrigerator is installed; and an elastic supporting member 620 coupled between the height control member 610 and the floor supporting means, for elastically supporting the base member 140 coupled to the main body 100.

The base member 140 is formed as a predetermined shape, and a female screw portion 141 is penetratingly formed therein. The base member 140 is fixedly coupled to the lower surface of the main body 100.

The height control member 610 includes: a body 611 formed as a predetermined shape; a coupling portion 612 extending and protruding from an upper side of the body 611 at a certain length, and having a male screw portion 613 at its end portion; a receiving space (S1) formed at the other side of the body 611 at a certain depth; and a sliding hole 614 penetratingly formed at the body 611. Preferably, the body 611 is formed as a cylindrical shape having a certain length. An insertion space (S2) having a certain depth is formed in the body 611. The sliding hole 614 is penetratingly formed in a longitudinal direction of the coupling portion 612.

The height control member 610 is coupled to the base member 140 by threading of the male screw portion 613 of the coupling portion 612 into the female screw portion 141 of the base member 140. The height control member 610 is positioned perpendicularly to the main body 100.

The floor supporting means includes: a leg 630 movably coupled to the height control member 610; and a vibration absorbing member 640 coupled to a lower surface of the leg 630. The leg 630 includes: a contact supporting portion 631 having certain thickness and area; and a shaft portion 632 extending from one surface of the contact supporting portion 631 at a certain length. The contact supporting portion 631 is preferably formed as a circular shape with a certain thickness. The shaft portion 632 is formed perpendicularly to the contact supporting portion 631. A male screw portion 633 is formed at an end portion of the shaft portion 632. The vibration absorbing member 640 is formed of an elastic material such as rubber. The vibration absorbing member 640 is coupled to a lower surface of the contact supporting portion 631 of the leg 630 and contacts with a floor.

The elastic supporting member 620 is a compression coil spring. An outer diameter of the compression coil spring is smaller than an outer diameter of the contact supporting portion 631.

The elastic supporting member 620 is inserted upon the shaft portion 632 of the leg. The leg 630 upon which the elastic supporting member 620 is inserted is coupled to the height control member 610 by inserting of the shaft portion 632 into the sliding hole 614 of the height control member. One side of the elastic supporting member 620 is in contact with an inner wall of a receiving space (S1) of the height control member 610, and its other side is in contact with an upper surface of the contact supporting portion 631. The vibration absorbing member 640 coupled to the lower surface of the contact supporting portion 631 of the leg contacts with the floor, the elastic supporting member 620 elastically supports the height control member 610, and the height control member 610 maintains a certain interval from an upper surface of the contact supporting portion 631 by the support of the elastic supporting member 620. The lower surface of the height control member 610 and an upper surface of the contact supporting portion 631 face each other. Preferably, an outer diameter of the height control member 610 is the same as an outer diameter of the contact supporting portion 631.

A stopper 634 is coupled to an end portion of the shaft portion 632 inserted in the sliding hole 614 of the height control member, and the stopper 634 contacts with a bottom surface of the insertion space (S2). The stopper 634 is formed of a nut, and the nut is threaded on the male screw portion 633 of the shaft portion.

A washer 650 is coupled between the elastic supporting member 620 and an inner wall of the receiving space (S1), and a spring supporting member 660 is coupled between the elastic supporting member 620 and the contact supporting portion 631.

Preferably, the washer 650 and the spring supporting member 660 are made of a rubber material.

Figure 5:
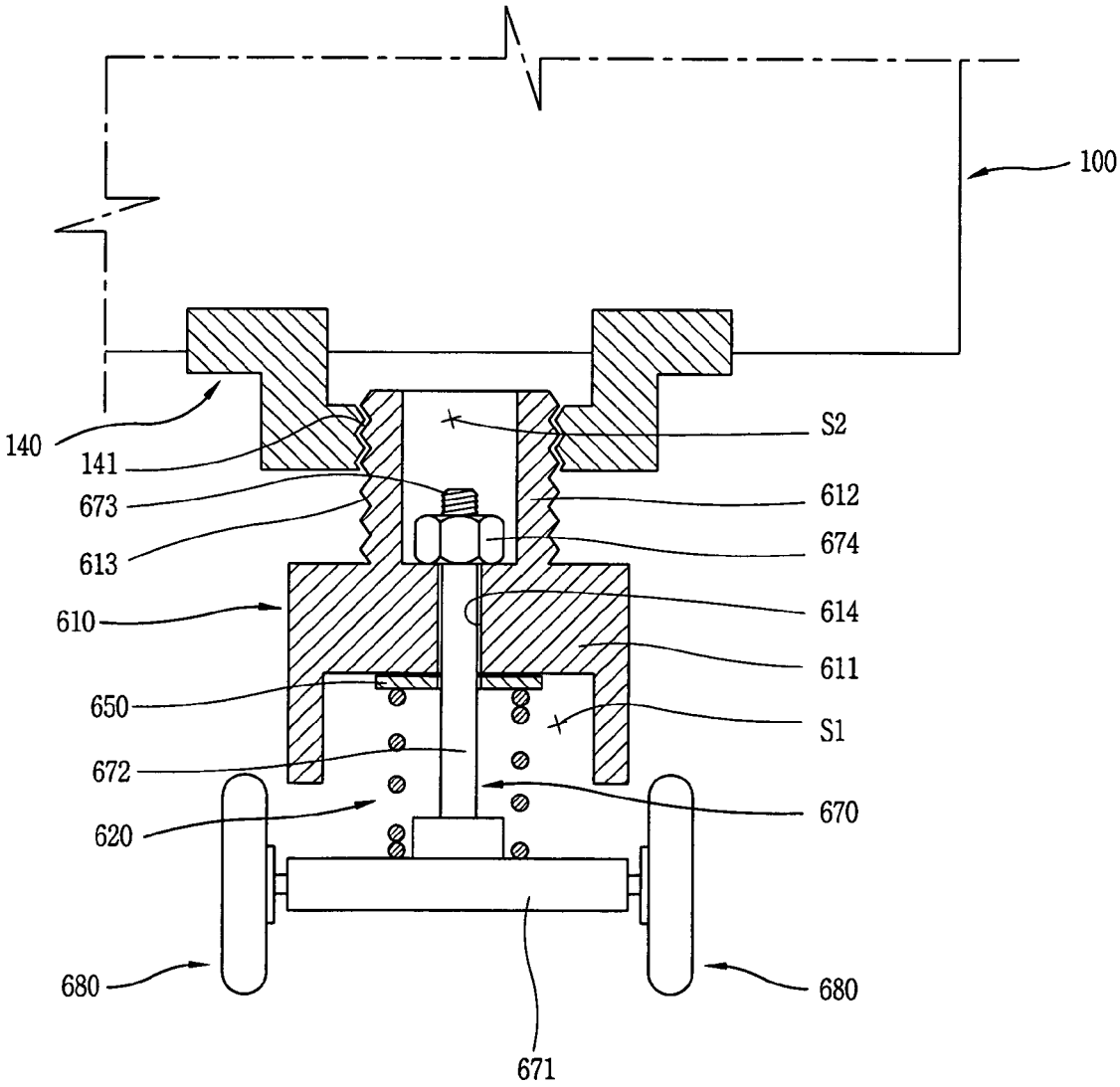
FIG. 5 is a sectional view showing another embodiment of the vibration-absorbing supporting apparatus of the wine refrigerator in accordance with the present invention.

As shown in FIG. 5, as a modified example of the floor support means, the floor supporting means comprises a leg 670 movably coupled to the height control member 610; and rollers 680 rotatably coupled to the leg 670. The leg 670 includes a support portion 671 having a predetermined shape; and a shaft portion 672 extending from the support portion 671 in a vertical direction. A male screw portion 673 is formed at an end portion of the shaft portion 672. The rollers 680 are rotatably coupled to both sides of the support portion 671 of the leg, respectively.

The elastic supporting member 620 is inserted upon the shaft portion of the leg 670. The leg 670 upon which the elastic supporting member 620 is inserted is coupled to the height control member 610 by inserting of its shaft portion 672 into the sliding hole 614 of the height control member 610. One side of the elastic supporting member 620 contacts with an inner wall of a receiving space (S1) of the height control member 610 and its other side contacts with the support portion 671.

The rollers 680 contact with a floor, the elastic supporting member 620 elastically supports the height control member 610, and the height control member 610 maintains a certain interval from the support portion 671 by support of the elastic supporting member 620.

A stopper 674 is coupled to an end portion of the shaft portion 672 inserted in the sliding hole 614 of the height control member 610, and the stopper 674 contact with a bottom surface of an insertion space (S1). The stopper 674 is a nut, and the nut is threaded on the male screw portion 673 of the shaft portion.

A washer 650 is coupled between the elastic supporting member 620 and an inner wall of the receiving space (S1).

Such a vibration-absorbing supporting apparatus is installed at each corner of a lower surface of the wine refrigerator main body 100. If provided with the rollers 680, the floor support means facilitates a movement of the wine refrigerator, and the rollers are preferably installed at a rear side of the lower surface of the main body 100.

The floor supporting means of the vibration-absorbing supporting apparatus contacts with and is supported on a floor on which the wine refrigerator is to be installed. If vibration is generated at the floor on which the wine refrigerator is installed, the vibration is transmitted to the elastic supporting member 620 through the floor supporting means, and the vibration having transmitted to the elastic supporting member 620 is absorbed thereby. In such a manner, transmitting of the vibration to the main body 100 is prevented. If the floor supporting means is provided with the vibration absorbing member 640, the vibration is primarily absorbed by the vibration absorbing member 640.

Also, since a height is controlled by rotation of the height control member 610, a horizontal state of the main body 100 is controlled, and installation of the wine refrigerator can be stably accomplished.

Figure 6:
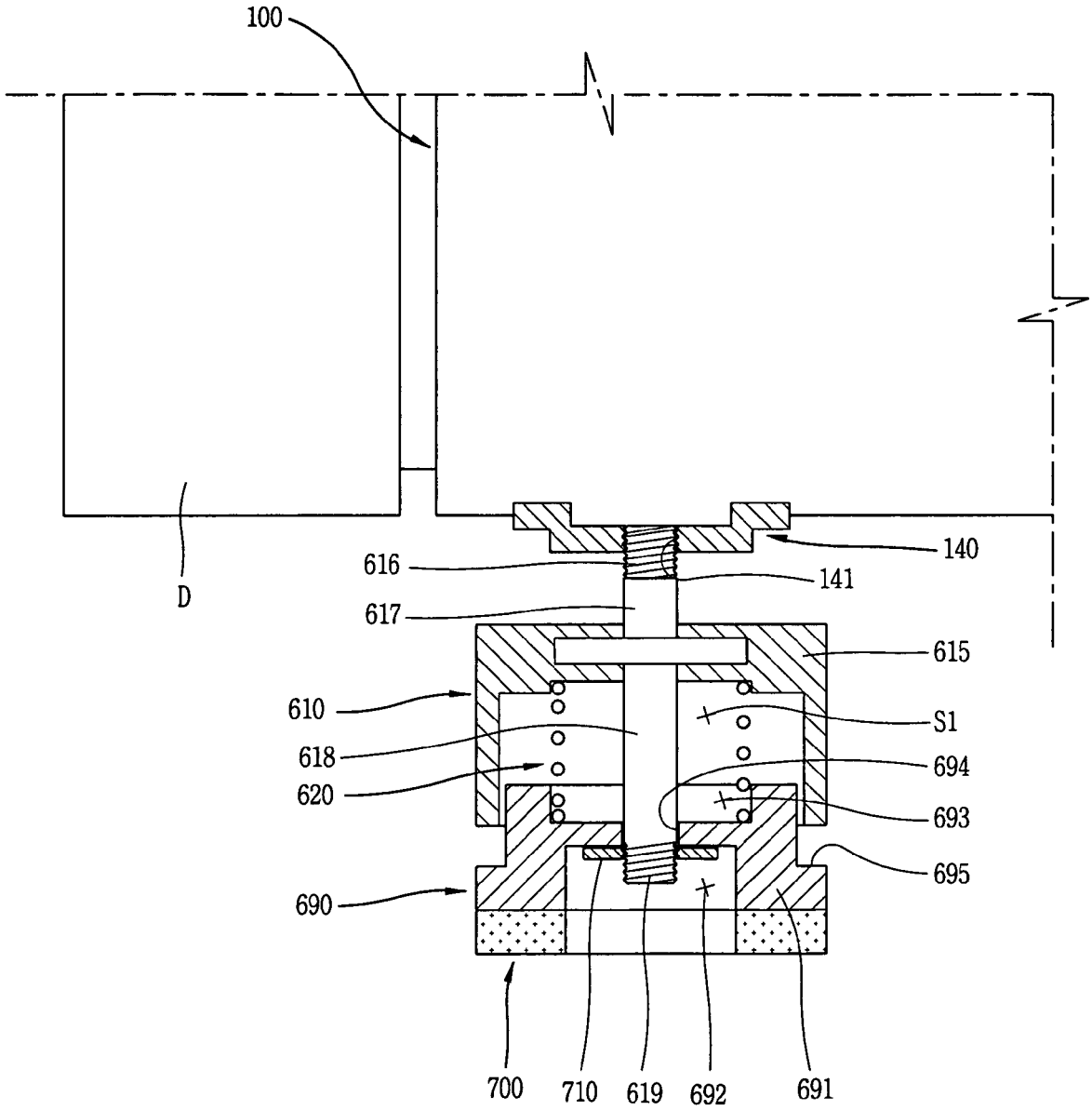
FIG. 6 is a sectional view showing still another embodiment of the vibration-absorbing supporting apparatus of the wine refrigerator in accordance with the present invention.

As shown in FIG. 6, according to another embodiment of the vibration-absorbing supporting apparatus according to the present invention, the height control member 610 includes: a body 615 formed as a predetermined shape; a coupling portion 617 extending and protruding from an upper side of the body 615 and having a male screw portion 616 at its end portion; a receiving space (S1) formed at the other side of the body 615 at a certain depth; and a shaft portion 618 extendingly formed at an inner surface of a receiving space (S1) of the body 615 at a certain length.

Preferably, the body 615 is formed as a cylindrical shape having a certain length, and the receiving space (S1) is formed as a circular shape having a certain depth. A male screw portion 619 is formed at an end portion of the shaft portion 618.

The height control member 610 is coupled to the base member 140 as the male screw portion 616 of its coupling portion is threaded in a female screw portion 141 of the base member 140. The height control member 610 is positioned perpendicularly to the main body 100.

The floor supporting means includes a foot 690 movably coupled to the height control member 610; and a vibration absorbing member 700 coupled to the lower surface of the foot 690.

The foot 690 includes: a contact supporting portion 691 formed as a cylindrical shape; an interior space 692 formed at a lower surface of the contact supporting portion 691 at a certain depth; an insertion groove 93 formed at an upper surface of the contact supporting portion 691 as a circular shape having a certain depth; and a sliding hole 694 penetratingly formed at the center of the contact supporting portion 691 in a vertical direction. A circular stepped surface 695 is formed at an outer circumferential surface of the contact supporting portion 691. An upper portion of the contact supporting portion 691 is smaller than an inner diameter of the receiving space (S1) of the height control member 610.

The vibration absorbing member 700 has a shape corresponding to the lower surface of the foot 690 and has a certain thickness, and is fixedly coupled to the lower surface of the contact supporting portion 691 of the foot.

The elastic supporting member 620 is a compression coil spring, and its outer diameter is smaller than an inner diameter of the insertion groove 693.

The floor supporting means is coupled to the height control member 610 by inserting of the shaft portion 618 of the height control member 610 into the sliding hole 694. Part of the upper portion of the foot 690 of the floor supporting means is positioned in the receiving space (S1) of the height control member 610. And a lower surface of the height control member 610 and the stepped surface 695 face each other at a certain interval therebetween.

A stopper 710 is coupled to an end portion of the shaft portion 618. The stopper is a nut, and the nut is threaded on the male screw portion 619 formed at the end portion of the shaft portion 618.

As for such a vibration-absorbing supporting apparatus having such a structure, its floor supporting means contacts with and is supported on a floor on which a wine refrigerator is to be installed. If vibration is generated at the floor on which the wine refrigerator is installed, the vibration is transmitted to the elastic supporting member 620 through the floor supporting means, and the vibration transmitted to the elastic supporting member 620 is absorbed by the elastic supporting member 620. In such a manner, the transmitting of the vibration to the main body 100 is prevented. The vibration absorbing member 700 primarily absorbs the vibration.

Also, since a height is controlled by rotation of the height control member 610, a horizontal state of the wine refrigerator main body 100 can be controlled, and installation of the wine refrigerator is stably accomplished.

Meanwhile, according to still another embodiment of the vibration-absorbing supporting apparatus in accordance with the present invention, the vibration-absorbing supporting apparatus includes: a floor supporting means coupled to a lower portion of the wine refrigerator main body 100 to make a relative motion in a perpendicular direction to the main body 100, and supported on a floor on which a wine refrigerator is to be installed; and an elastic supporting member 620 coupled between the main body 100 and the floor supporting means, for elastically supporting the main body 100.

In the vibration-absorbing supporting apparatus, the base member 140 and the height control member 610 are constructed as one component together with the main body 100, unlike above described embodiment in which the height control member 610 is coupled to the base member 140 to control a height. And, the main body 100 in which the base member 140 and the height control member 610 are constructed as one body is also provided with the elastic supporting member 620 and the floor supporting means.

In such construction, although a height control function is excluded, the vibration generated from the floor is effectively absorbed, so that the vibration generated at the floor is prevented from being transmitted to the main body 100.

Hereinafter, the operation and effect of the vibration-absorbing supporting apparatus of the wine refrigerator in accordance with the present invention will now be described.

The vibration-absorbing supporting apparatus of the wine refrigerator in accordance with the present invention is mounted to a lower portion of the wine refrigerator main body 100, and the vibration-absorbing supporting apparatus contacts with a floor on which the wine refrigerator is installed, thereby supporting the main body 100 in which wine bottles are stored.

If vibration is generated at a floor on which the wine refrigerator is installed, namely, if vibration is generated at a floor by vibration generated from other appliances installed near the wine refrigerator or by vibration generated while children run around, the elastic supporting member 620 that elastically supports the main body 100 and the floor supporting means absorbs the vibration. Thus, the transmitting of the vibration to the main body 100 is prevented, and shaking of the wine bottles stored in the main body 100 is also prevented.

As so far described, the vibration-absorbing supporting apparatus of the wine refrigerator in accordance with the present invention prevents wine bottles stored in the main body from being shaken due to vibration generated at a floor on which the wine refrigerator is installed. Accordingly, quality deterioration of bottled wine is prevented, and the wine can be stored, maintaining its own flavor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vibration-absorbing supporting apparatus of a wine refrigerator comprising:

a base member fixedly coupled to a lower portion of a wine refrigerator main body;

a height control member coupled to the base member so as to control a height of the main body vertically, the height control member including:

a body formed as a predetermined shape;

a coupling portion extending and protruding from an upper side of the body at a certain length and coupled to the base member to be vertically movable;

a receiving space formed at the other side of the body at a certain depth; and a sliding hole penetratingly formed at the body;

a floor supporting means coupled to the height control member to make a relative motion to the height control member in a vertical direction, and contacting with and supported on a floor on which the wine refrigerator is installed, the floor supporting means including:

a contact supporting portion having a predetermined area; and a shaft portion extendingly formed at the contact supporting portion at a certain length and inserted in the sliding hole; and an elastic supporting member separate from the height control member, the elastic supporting member being coupled between the height control member and the floor supporting means, for elastically supporting the base member coupled to the main body, the elastic support member being a compression spring, wherein the compression spring is inserted upon the shaft portion, and both sides of the spring contact with and are supported by an inner wall of the receiving space and an upper surface of the contact supporting portion, respectively.

2. The apparatus of claim 1, wherein the base member and the height control member are screw-coupled together.

3. The apparatus of claim 1, wherein the height control member is provided with a receiving space in which the elastic supporting member is positioned.

4. The apparatus of claim 1, wherein the floor supporting means is provided with a vibration absorbing member for absorbing vibration.

5. The apparatus of claim 1, wherein rubber members are inserted between the height control member and the elastic supporting member and between the floor supporting means and the elastic supporting member, respectively.

6. The apparatus of claim 1, wherein a stopper for limiting a vertical movement of the floor supporting means is provided at the height control member and the floor supporting means.

7. The apparatus of claim 1, wherein the floor supporting means is provided with a roller to be rotatable on a floor.

8. The apparatus of claim 1, wherein a stopper for limiting a movement of the shaft portion is coupled to an end portion of the shaft portion.

9. The apparatus of claim 1, wherein a washer is coupled between the elastic supporting member and an inner wall of the receiving space.

10. The apparatus of claim 1, wherein a spring supporting member is coupled between the elastic supporting member and the contact supporting portion.

11. The apparatus of claim 1, wherein an edge of the receiving space of the body faces the contact supporting portion at a certain interval therebetween.

12. The apparatus of claim 1, wherein the a vibration absorbing member for absorbing vibration is coupled to a lower surface of the contact supporting portion.

13. The apparatus of claim 1, wherein the floor supporting means comprises:

a support portion having a predetermined area;

a shaft portion extendingly formed at the support portion in a vertical direction and inserted in the sliding hole, upon which the elastic supporting member is inserted; and rollers rotatably coupled to both sides of the support portion.

14. A vibration-absorbing supporting apparatus comprising:

a height control member couplable to a member that is to be supported by the vibration-absorbing apparatus;

a floor supporting means coupled to the height control member to make a relative motion to the height control member in a vertical direction, the floor supporting member being configured to be supported by a floor, the floor supporting means including:

a contact supporting member having a predetermined area; and a shaft portion extendingly formed at an upper surface of the contact supporting portion; and an elastic supporting member coupled between the height control member and the floor supporting means to elastically support the member, the elastic supporting member being a compression spring inserted upon the shaft portion.

15. The apparatus of claim 1, wherein the floor supporting means comprises:

a contact supporting portion having a predetermined area; and a shaft portion extendingly formed at an upper surface of the contact supporting portion, wherein the elastic supporting member is inserted upon the shaft portion.

16. The apparatus of claim 14, wherein the height control member comprises:

a body having an upper surface and a lower surface;

a coupling portion extending from the upper surface, the coupling portion being coupable to the member to be vertically moveable; and a sliding hole penetrating the body, wherein the shaft portion of the floor supporting means is inserted in the sliding hole.

17. The apparatus of claim 16, wherein the lower surface of the body defines a receiving space and the compression spring contacts both the lower surface of the body and the upper surface of the contact supporting portion.

18. A vibration-absorbing supporting apparatus comprising:

a height control member couplable to a member that is to be supported by the vibration-absorbing apparatus, the height control member including:

a body having an upper surface and a lower surface; and a hole penetrating the body;

a floor supporting means coupled to the height control member to make a relative motion to the height control member in a vertical direction, the floor supporting member being configured to be supported by a floor, the floor supporting means including:

a contact supporting portion having a predetermined area; and a shaft portion extendingly formed at an upper surface of the contact supporting portion, the shaft portion being moveable within the hole of the height control member; and an elastic supporting member coupled between the height control member and the floor supporting means to elastically support the member, wherein the floor support means is relatively moveable with respect to the height control member.

19. The apparatus of claim 18, wherein the height control member includes a coupling portion extending from the upper surface, the coupling portion being coupable to the member to be vertically moveable.

20. The apparatus of claim 19, wherein the lower surface of the body defines a receiving space and the elastic supporting member contacts both the lower surface of the body and the upper surface of the contact supporting portion.

* * * * *